United States Patent [19]

Watchorn

[11] Patent Number: 4,548,153

[45] Date of Patent: Oct. 22, 1985

[54] BUOYANT CONCRETE FOUNDATION AND METHOD THEREFOR

[75] Inventor: Ernest W. Watchorn, Vancouver, Canada

[73] Assignee: Confloat Consulting Ltd., Vancouver, Canada

[21] Appl. No.: 398,998

[22] Filed: Jul. 16, 1982

[51] Int. Cl.[4] ..... B63B 3/00

[52] U.S. Cl. ..... 114/267; 114/65 A; 405/218

[58] Field of Search ..... 114/266, 267, 263, 65 A; 405/218, 219; 264/251, 256, 71, 309; 52/650, 289

[56] References Cited

U.S. PATENT DOCUMENTS

| | | | |
|---|---|---|---|
| Re. 24,837 | 6/1960 | Usab | 114/266 |
| 2,064,789 | 12/1936 | Faber | 52/289 |
| 3,622,656 | 11/1971 | Dewey, Jr. | 52/650 |
| 3,799,093 | 3/1974 | Thomson | 114/266 |
| 3,967,569 | 7/1976 | Shorter, Jr. | 114/266 |
| 4,117,071 | 9/1978 | Hannah | 264/256 |
| 4,318,361 | 3/1982 | Sluys | 114/266 |
| 4,364,987 | 12/1982 | Goodwin | 264/256 |

OTHER PUBLICATIONS

CeFer Designs Publication, circulated Apr., 1981 "Positive Flotation Concrete Floating Foundations".

*Primary Examiner*—Trygve M. Blix
*Assistant Examiner*—Edwin L. Swinehart
*Attorney, Agent, or Firm*—Hughes, Barnard & Cassidy

[57] ABSTRACT

A bouyant foundation comprising a substantially unitary concrete hull defined by bottom, side and end walls; at least one partial bulkhead wall disposed generally normal to and spanning the bottom wall and having a height less than that of the upstanding walls to yield a plurality of recessed flotation cavities bounded by flotation cavity side walls; generally rectilinear flotation block members, having reentrant sidewall portions, disposed within the flotation cavities; restraining wedge members integral with the flotation cavity sidewalls received within the reentrant portions of the flotation block members for fixedly retaining the same within the cavities, and a method for fabricating such a structure comprising the steps of establishing a construction form including bottom, side and end wall form members; depositing a concrete mixture on the form members to yield a substantially unitary hull including concrete bottom side and end walls; positioning a plurality of positive flotation members as internal bulkhead form-defining members on the bottom wall in a spaced array spanning the interior of the hull, each of the bulkhead form-defining members having rectilinear configuration and yielding bulkhead channels between adjacent form-defining members having a height less than that of the upstanding walls and further wherein each of the form-defining members includes reentrant sidewall portions lying along an axis generally parallel to the axis of the channels; and charging the channels and the reentrant sidewall portions of each of the form-defining members with a concrete mixture to form partial bulkheads spanning the interior of the hull.

11 Claims, 5 Drawing Figures

BUOYANT CONCRETE FOUNDATION AND METHOD THEREFOR

BACKGROUND OF THE INVENTION

1. Field of the Invention

The present invention relates, generally, to buoyant concrete foundations adapted for supporting a building structure on a body of water and, more especially, to an improved buoyant concrete foundation including positive flotation members as integral components thereof and methods for fabricating such foundations.

2. Description of the Background Art

The use of concrete as a building material for the fabrication of floating structures has become quite popular over the last several decades. Concrete offers many advantages over wood, the historic material of choice in the construction of floating docks, piers, and the like. Perhaps the single most important advantage of concrete lies in its greater service longevity as a consequence of its lesser tendencies for degradation; in fact, not only is concrete stronger than wood, its strength increases upon aging. Concrete offers the further advantage of permitting a structure of substantially unitary design. Accordingly, the use of concrete in the fabrication of all varieties of floating structures is now becoming quite widespread.

Many have proposed the use of concrete for float units employed in the construction of wharf structures. For example, U.S. Pat. No. Re. 24,837 discloses such a floating structure consisting of a plurality of units having a generally rectilinear form. A base member is comprised of an overall rectangular float member having a bottom wall and upstanding side and end walls, divided internally by a plurality of bulkheads to yield a series of chambers. A top wall provides a closure means for each of these units, which are provided with peripheral members for affixing a series of floats in a desired configuration. The buoyancy for the float is achieved by the internal cavities of each unit.

Some have suggested refinements on this overall approach, particularly in response to the potential that water may find its way within the internal chambers and cause a loss of buoyancy of the floats. To this end, various types of buoyant materials have been disposed within internal cavities in flotation units to displace any water which might find a path therein. Exemplary of such approaches may be mentioned the flotation units disclosed in U.S. Pat. Nos. 3,779,192, 3,967,569, and 4,070,980. In general a cellular polymeric foam, such as expanded polystyrene or polyurethane, is disposed substantially completely within a closed chamber, the walls of which comprise the concrete float or buoyant structure.

A somewhat different approach is suggested in U.S. Pat. No. 3,215,108, which discloses a floating structure specifically designed to support a building such as a boathouse on a body of water. That patent describes the use of an expanded polymer such as polystyrene where the same forms a flotation medium through and about which are associated frame members for the foundation.

U.S. Pat. No. 4,252,470 reveals a system for the distribution of a utility service, such as electrical power, telephone and/or water service, throughout a floating pier assembly comprised of a plurality of buoyant concrete float members. Each of the concrete float members is formed in the general shape of a rectangular concrete shell filled with a buoyant material, such as an expanded polymer, and these units are assembled into the overall shape of the desired pier configuration. As respects one element of the buoyant foundation of the present invention, it should be remarked that the buoyant members are formed with different sidewall geometries, including reentrant geometries, which appear to be included in order to provide thickened wall sections of the completely encapsulating concrete shell at places where adjacent members are joined.

A process for fabricating a concrete buoy is disclosed in U.S. Pat. No. 3,622,656. A reinforcing matrix frame, including screen members, is provided to define a form for the walls of the buoy and a cement mixture is applied by a spray technique to that frame. The patentees there strive to provide an on-site, formless molding of a unitary buoy which may include fairly complex geometries.

While many have applied themselves to the task of developing various types of buoyant concrete structures, there is yet to be provided a buoyant concrete foundation which may serve as a support for a wide range of building structures and which is simply and efficiently fabricated with an eye toward this particular aim.

SUMMARY OF THE INVENTION

The present invention advantageously provides both a buoyant concrete foundation and method for fabricating the same, where the foundation is destined to support a building structure on a body of water. The instant foundation design advantageously incorporates restrained positive flotation members within the lower portion thereof and permits for the inclusion of additional flotation members as may be required by the load placed on the foundation. The method of the instant invention is desirable for its simplicity and yet efficiency in the fabrication of these floating structures, minimizing significantly the use of certain form members by employing components of the foundation itself as form-defining means.

The foregoing and other advantages are realized in a buoyant concrete foundation configured for supporting a building structure on a body of water, comprising a concrete hull of substantially unitary construction defined by a bottom hull wall and upstanding side and end hull walls along with at least one upstanding, partial bulkhead wall disposed generally normal to the bottom hull wall and having a height less than that of the upstanding hull walls to yield a plurality of recessed flotation cavities. The recessed flotation cavities receive and contain positive flotation members, such as blocks of an expanded polymer (e.g., polystyrene), which are restrained within the flotation cavities by laterally extending projection on the partial bulkhead walls which mate, in a wedge-type arrangement, within a kind of reentrant sidewall geometry provided in the flotation members. The space between the surface of the captured flotation members and the bottom surface of floor joist members, which are disposed across the upstanding hull walls to receive the building structure, may retain additional flotation blocks depending upon the load to be placed on the foundation.

The upper edges of at least the upstanding hull sidewalls, and preferably the hull end walls as well, are provided with integral fender means removably secured thereto so that the fender(s) may be replaced once past a useful service life. The upper edge portions of at least one pair of the side or end walls are also provided with thickened footings area within which are restrained a plurality of anchor bolts for receipt of the floor joists.

The buoyant foundation is fabricated by a series of steps which reduce the number of extraneous form members in order to improve not only the efficiency of manufacture but the reliability of the foundation in use. The method includes the steps of establishing a construction form corresponding to the overall hull configuration, including a bottom wall form member and upstanding side and end wall form members, onto which is deposited a concrete mixture preferably by a spray application technique. In the initial layup, the fender members for the foundation comprises the upper portion of the concrete-receiving form. After concrete has been applied to the overall form, and preferably before a cure, a plurality of positive flotation blocks such as blocks of expanded polystyrene are disposed upon the bottom wall in a spaced relationship to define a series of transversely extending channels therebetween. Concrete is poured within these channels to yield the partial bulkhead walls extending in a generally transverse direction across the lower portion of the hull. The flotation blocks are configured to include a type of reentrant sidewall geometry so that a slight thickening of the bulkhead wall occurs at the location where concrete is poured within the channel, thereby providing restraint for the flotation blocks. While a variety of reentrant geometries might be employed, it is preferred that the blocks be formed with a slight inwardly directed taper along the corner edges thereof to simplify the fabrication technique.

The method also includes the step of establishing troughs near the upper edge of at least the hull sidewall forms in order to receive sufficient concrete mixture to yield a thickened footing area within which are restrained a plurality of anchor bolts for receipt of the floor joists for supporting the structure on the foundation. Once the hull has cured, additional flotation blocks may be laid upon the restrained flotation members, beneath the floor joist area, should the restrained flotation blocks be insufficient as respects the anticipated load of the structure on the foundation.

Other advantages of the present invention and a fuller appreciation of its structure and method of fabrication will be gained upon examination of the following detailed description of the invention, taken in conjunction with the figures of the drawing, wherein:

DETAILED DESCRIPTION OF THE INVENTION

The present invention relates, generally, to buoyant concrete foundations for supporting building structures on a body of water and methods for fabricating such foundations. Accordingly, the present invention will now be described with reference to certain preferred embodiments within the aforementioned context; although those skilled in the art will appreciate that such a description is meant to be exemplary only and should not be deemed limitative.

Figure 1:
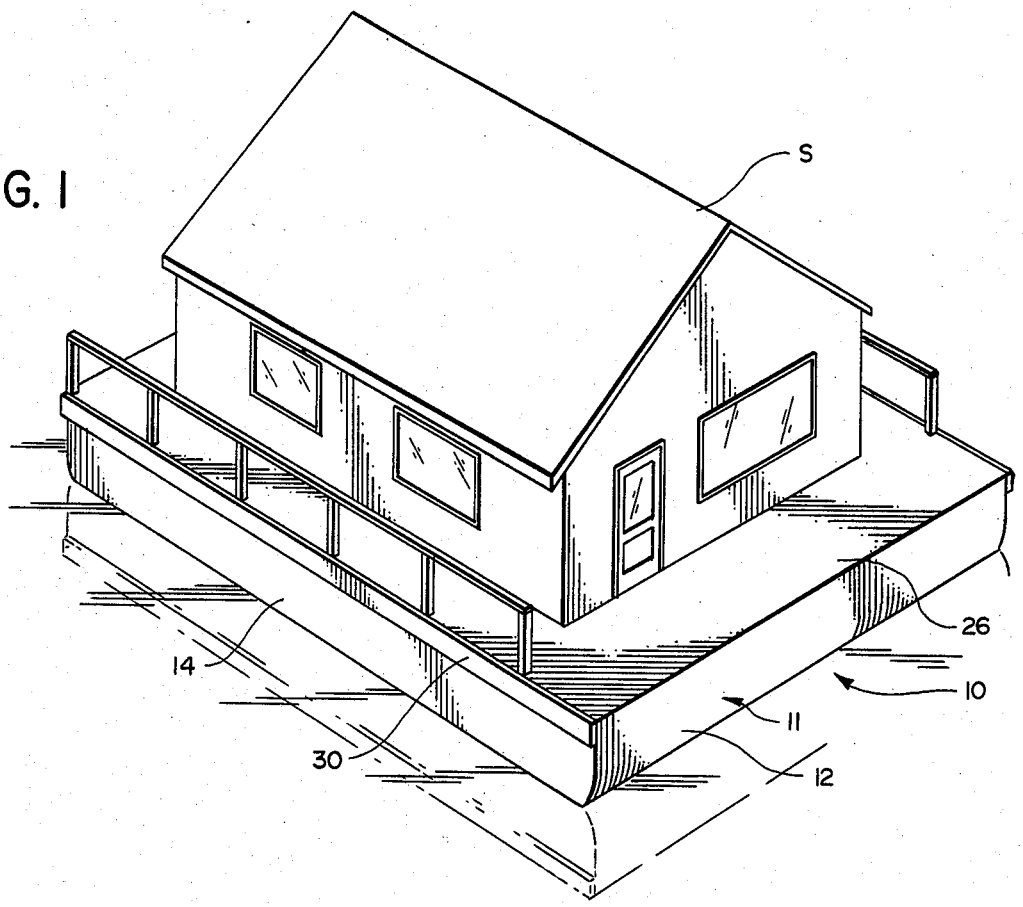
FIG. 1 is an isometric view of a buoyant concrete foundation in accordance with the present invention, shown supporting a building structure on a body of water.
Figure 2:
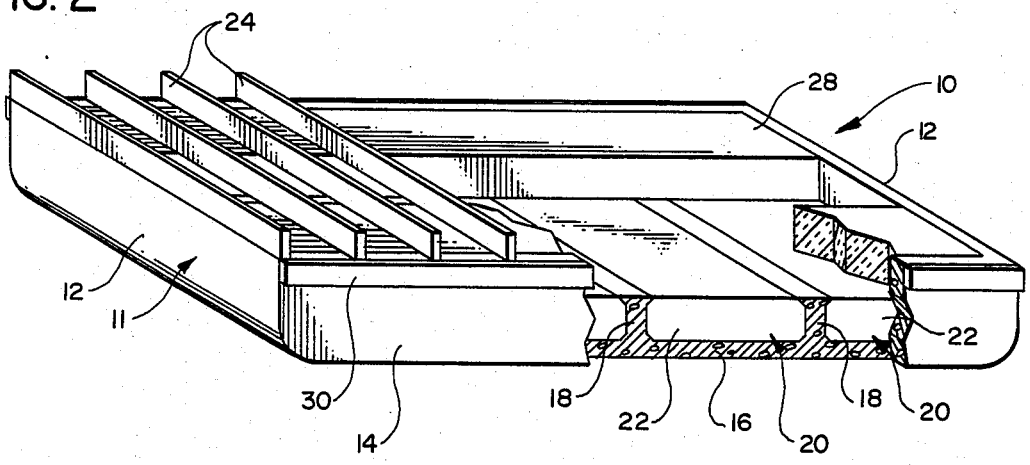
FIG. 2 is an isometric view, with parts broken away, of the foundation shown in FIG. 1.

Turning to the figures of drawing, in all of which like parts are identified with like reference numerals, FIG. 1 illustrates a building structure S supported upon a buoyant foundation of the present invention, designated generally as 10. FIG. 2 illustrates certain of the basic structural features of the foundation.

The foundation 10 is in the form of a hull 11 comprised of upstanding hull end walls 12, upstanding hull sidewalls 14, and a hull bottom wall 16; all of which are fabricated from a concrete material. The hull structure itself includes at least one, and preferably several, internal partial bulkhead walls 18 spanning the interior thereof. Normally, the bulkheads 18 will extend transversely from sidewall to sidewall, but there may be occassions where the designer will include bulkheads spanning the end walls in lieu of or in addition to those extending between the sidewalls. In any of these events, a plurality of flotation cavities 20 are defined intermediate the partial bulkhead walls 18 and also between the end walls 12 and first adjacent bulkheads. Positive flotation blocks 22, preferably formed from an expanded polymeric material such as expanded polystyrene, are disposed within the flotation cavities 20 and preferably captured therein by the bulkhead walls 18 as described more fully hereinbelow. Floor joists 24 are supported across the upper surface of the full structure for receiving the structure S and an optional deck area 26 where the structure has peripheral dimensions less than that of the foundation 10. In cases where the anticipated load on the foundation 10 is greater than that accommodated by the restrained flotation blocks 22, additional flotation blocks 28 may be sandwiched between the upper surface of those restrained blocks and the joists 24. Preferably, at least the sidewalls 14 include fenders, designated 30, of any convenient material; treated fir being a particularly suitable one for this purpose. Normally, the endwalls 12 will also be provided with similar fenders.

Figure 3:
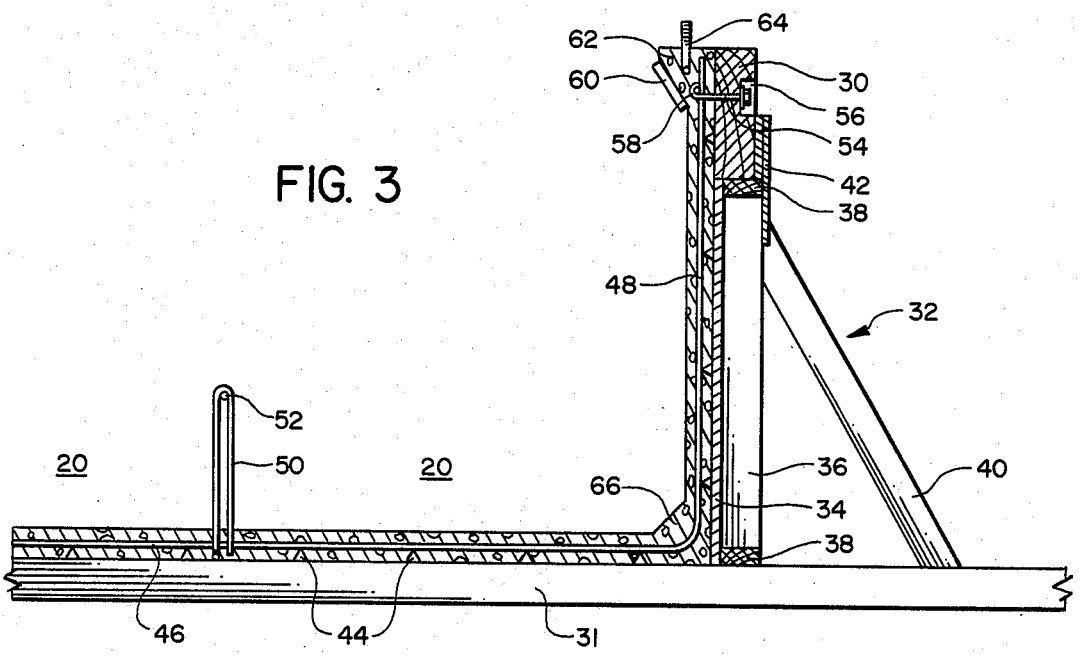
FIG. 3 is a fragmentary side sectional view of a partially-formed foundation.
Figure 4:
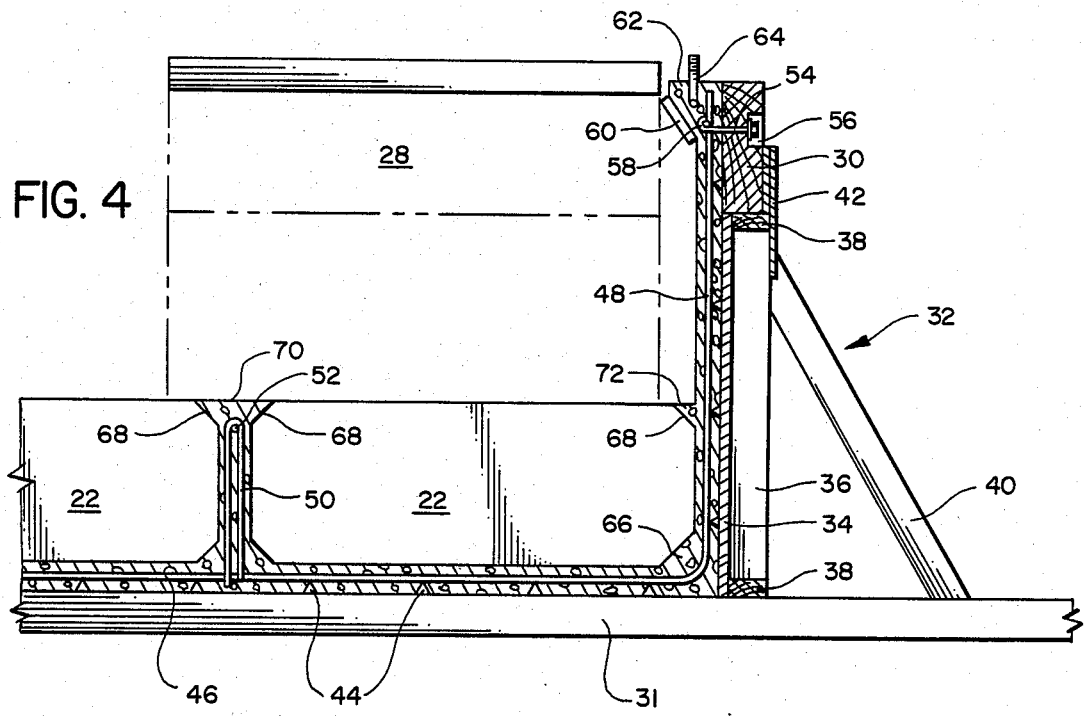
FIG. 4 is a view similar to FIG. 3, but showing the foundation nearer its finished configuration; and, FIG. 5 is a fragmentary sectional view illustrating diagrammatically various geometries for retaining the lower layer of positive flotation blocks within the hull structure.

FIGS. 3 and 4 illustrate a sequence for the most preferred fabrication methodology employed for the foundation 10; and also show, in greater detail, certain of the structural components mentioned above. For ease of description, only one corner of the foundation is shown in these figures; but those skilled in the art will have no difficulty extrapolating to a complete foundation structure.

The first step in the fabrication technique comprises establishing a construction form corresponding to a desired hull configuration. Accordingly, a hull bottom wall form member 31 receives end hull wall form members designated generally 32 (only one of which is shown) and side hull wall form members (not shown) defining the overall configuration of the hull to be produced. The hull wall form members may be made from any convenient material, such as wood, to which is applied a conventional separating compound used in concrete construction. In the embodiment shown, the end wall form member 32 is comprised of an inner plywood sheet 34 supported by a series of wooen studs 36 secured in position by lateral frame members 38 and angular brace members 40 to provide sufficient rigidity to the upstanding form. The sidewall form members are erected in substantially the same way. It will be appreciated by those skilled in the art that the absolute configuration of the hull, for example the inclusion of sloped or tapered end walls in order to afford better hydrodynamics for the float, are provided by suitably tailoring the form members corresponding to those structural walls.

A remarkable aspect of the present invention is the manner in which the fender 30 (whether it be on a side hull wall or end hull wall or be included on both) cooperates to comprise a portion of the form for that wall and the manner in which it is subsequently restrained in place on the foundation 10. As viewed in FIGS. 3 and 4, the fender is secured to the upper cross brace 38 as a continuous extension of the plane defined by plywood member 34. Initially, the fender is simply secured by an outer wooden member 42 to maintain alignment of the fender on the form brace; being restrained in place in later sequences by the concrete reinforcing network as described below.

Once the overall form has been established, including the portions where fenders are to be incorporated within the float, the separating compound is applied (in the event those members have not been pre-treated) and a network of reinforcement members is secured to the form work. First, a plurality of chairs 44 are disposed at suitable, spaced locations for receipt of conventional steel reinforcing bar members, identified as 46 for the bottom hull wall and 48 for the end hull wall. The chairs 46 raise the "re-bars" 46 and 48 in order that the same are positioned away from the face area corresponding to the wall members and thereby assume a position intermediate the thickness of the wall to be formed. As is conventional in concrete construction, the re-bars are wired or otherwise suitably attached to the chairs in order to maintain their orientation prior to the concrete casting procedure. A series of re-bar assemblies 50 are also disposed transversely of the erected form members corresponding in place and size to accommodate the dimensions of the bulkheads 18 to be formed during subsequent fabrication. The re-bar assemblies 50 may be supported upon a transversely extending rod member 52, spanning the width of the form, or by any other convenient technique. During the step of establishing the reinforcing network, it is also envisioned that fasteners 54 will be inserted through recessed or countersunk holes 56 in the fender 30, each of which fasteners include a hook-like end 58 receiving one of the upwardly projecting re-bars 48 internally thereof. The fasteners 54 aid in locating the fender properly and, once cast within the concrete hull wall, will serve as fixture means for the fender. When a fender requires replacement, it is very simply removed from the fasteners and a new one installed thereon.

It is highly preferred to include a thickened footing section near the upper edges of the upstanding hull walls in order to provide a better and more secure place for receiving and supporting the floor joists 24. Thus, it is highly preferred to place an angled form member 60 near the upper edge of the hull form, disposed slightly outward of the position to be assumed by these upstanding walls, to form a trough for receipt of concrete material. These angle form members 60 are easily secured across the form, and may be braced as required depending on the span to be accommodated.

With the form erected and the re-bar network positioned in place thereon as aforesaid, concrete is then deposited upon the bottom hull wall and the upstanding end and side hull wall form members. The preferred technique is by spray application using, e.g., the so-called "Gunite" process. By appropriate control of the process, a matter within the skill of the art, the concrete is "shot" or propelled against the form as a uniform layer to yield the bottom, end, and side hull walls defining the overall shape of the foundation. Where the preferred angle trough members are included, this will also yield a thickened footing area 62 corresponding to the placement of those members and within which may be received and restrained a plurality of anchor bolts 64 for securing the floor joists to the foundation. Likewise, slightly bevelled thickened edge sections 66 are preferably included during this initial concrete-depositing step, to avoid sharp corners within the hull which might otherwise be prone to failure due to stress concentration.

The transverse bulkhead walls 18 are fabricated while the concrete previously applied to the external form members is still in its uncured state, and preferably while still "tacky." As can be seen with reference to FIG. 3, the area defined between the position of re-bar assembly 50 and the end wall form supporting the concrete mixture defines one of the flotation cavities 20. Likewise, it can be envisioned that the areas defined between successive locations for the transverse bulkheads, defined at this stage simply by the re-bar assemblies 50, also correspond to these flotation cavities or cavity precursors. At this stage, positive flotation blocks 22 are disposed within each of the flotation cavities or precursors 20 as indicated generally in FIG. 4. The blocks 22 collaterally serve as forms for defining the dimensions of the partial transverse bulkheads 18. In the preferred form of the invention, each of the blocks has a width accommodating the dimension of the bulkhead to be formed and also a height corresponding to the desired height of the bulkheads 18. Each block is also formed with a type of reentrant sidewall geometry, shown in FIG. 4 to be a tapering of the top edge corners 68, in order that the block 22 may be restrained firmly within the flotation cavity 20 once the hull is completed. With the flotation blocks in place as shown in FIG. 4, concrete is then deposited within the channel between successive blocks to form the bulkhead walls 18, which terminates at a broadened upper face 70. Likewise, the edges along the upstanding walls of the hull receive a slight quantity of concrete, such as is indicated at 72 in FIG. 4, to fill the reentrant sidewall void and thereby provide restraint for that side of the terminal flotation block 22. When the hull in this form is allowed to cure, the form members may then be striped away to leave a foundation substantially in the form as the one shown in FIG. 2. Where necessary or desirable, the additional flotation blocks 28 may be laid upon the lower blocks 22 and the floor joists erected upon the anchor bolts 64. Construction of the structure S and deck area 26 may then proceed as is conventional.

In the event that water is able to gain entry within the interior of the foundation 10, it will be displaced by the positive flotation members 22 and 28. Not only do the transverse partial bulkheads 18 serve to rigidify the overall foundation structure, the thickened upper portion 70 and the added lip area 72 firmly restrain the lower flotation blocks so that the same may not rise upwardly on any water inadvertently gaining access to the interior of the foundation. Similarly, the upper flotation blocks 28, where present, will be wedged beneath the floor joists 24 so that the same will not be free to move about in response to the presence of any water finding its way within the foundation.

Figure 5:
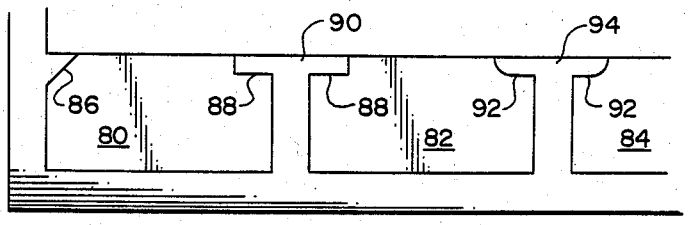

FIG. 5 illustrates a number of alternative geometries for the reentrant sidewall portion of the lower flotation blocks 22. For the sake of simplicity, these geometries are depicted as within a single foundation; however, normally only one would be selected. FIG. 5 shows three successive flotation blocks identified 80, 82 and 84. Flotation block 80 is formed with an upper reentrant sidewall geometry 86 in the form of a taper like the taper 68 illustrated in FIG. 4. The juncture between the blocks 80 and 82 is shown to be a more rectangular notch 88 in the respective sidewalls so that the partial bulkhead wall will be formed with a rectangular cap 90 providing the restraining force on those flotation blocks. The juncture between the flotation blocks 82 and 84 is a rounded or curved reentrant geometry 92 which functions in a like manner to yield a cap 94 also serving to restrain those blocks. All manner of other geometries might equally well be included to serve this purpose. Furthermore, it is envisioned that the reentrant portion of the sidewall may be beneath the top surface, lying intermediate the upper and lower edges of the flotation block; albeit, while the same restraining function is provided, this will complicate somewhat the fabrication technique and for that reason alone has not been illustrated and is not as preferred as those which are.

While the invention has now been described with reference to certain preferred embodiments thereof, those skilled in the art will appreciate that various substitutions, changes, modifications and omissions may be made without departing from the spirit thereof. Accordingly, it is intended that the scope of the present invention be limited solely by that of the claims granted herein.

What is claimed is:

1. A buoyant concrete foundation for supporting a building structure on a body of water; said concrete foundation comprising, in combination:

(a) a hollow concrete hull comprising a bottom hull wall and upstanding side and end hull walls;

(b) means defining at least one upstanding internal concrete partial bulkhead wall spanning said hull and having a height less than that of said upstanding side and end hull walls for subdividing the lower region of said hollow concrete hull into a plurality of first positive flotation cavities underlying a single second hollow cavity defined by the upper portions of said upstanding side and end hull walls;

(c) nonenveloped positive flotation block means disposed entirely within each of said first positive flotation cavities for establishing positive buoyancy for said buoyant concrete foundation, said nonenveloped positive flotation block means having their sides profiled to define reentrant sidewall portions having transverse dimensions less than the overall transverse dimensions of said nonenveloped positive flotation block means;

(d) first wedge defining means formed on and integral with said upstanding side and end hull walls at a level intermediate said bottom hull wall and the free upper edges of said upstanding side and end hull walls, said first wedge defining means projecting into said plurality of first positive flotation cavities in overlying relation to the adjacent reentrant sidewall portions of said nonenveloped positive flotation block means for retaining said nonenveloped positive flotation block means captive within said plurality of first positive flotation cavities; and, (e) second wedge defining means formed on and integral with said at least one upstanding internal concrete partial bulkhead wall and lying in a plane containing said first wedge defining means, said second wedge defining means projecting into said plurality of first positive flotation cavities in overlying relation to the adjacent reentrant sidewall portions of said nonenveloped positive flotation block means for retaining said nonenveloped positive flotation block means captive within said plurality of first positive flotation cavities, whereby said nonenveloped positive flotation block means, while retained captive within said plurality of first positive flotation cavities, have their upper surfaces freely exposed to said overlying second hollow cavity defined by the upper portions of said upstanding side and end hull walls.

2. The buoyant concrete foundation of claim 1, wherein one opposing pair of said upstanding side and end hull walls includes concrete footing means along the top edges thereof and floor joist fixture bolt means restrained therein.

3. The buoyant concrete foundation of claims 1 or 2, wherein at least one opposing pair of said upstanding side and end hull walls includes fender means disposed proximate the upper, outer edges thereof, said fender means being releasably secured thereto by fixture bolts disposed outwardly from and restrained within said upstanding side and end hull walls.

4. The buoyant concrete foundation of claim 3, wherein said reentrant sidewall portions of said nonenveloped positive flotation block means are comprised of inwardly disposed notches proximate the upper corners thereof and said first and second wedge defining means comprise concrete projections extending laterally from and integral with said at least one upstanding internal partial bulkhead wall and said upstanding side and end hull walls disposed within said notches.

5. The buoyant concrete foundation of claim 2, further comprising floor joists spanning said hull and secured thereto on said floor joist fixture bolt means.

6. The buoyant concrete foundation of claim 5, further comprising second nonenveloped positive flotation block means disposed in said single second hollow cavity intermediate said plurality of first positive flotation cavities and said floor joists.

7. The method of fabricating a buoyant concrete foundation for supporting a building structure on a body of water; said method comprising the steps of:

(a) establishing a hollow construction form corresponding to a desired hull configuration and including a bottom hull wall form member and upstanding side and end hull wall form members;

(b) depositing a concrete mixture onto the inner surfaces of the bottom, side and end hull wall form members to form a hollow concrete hull having a bottom hull wall and integral upstanding side and end hull walls;

(c) positioning a plurality of nonenveloped positive flotation blocks, each having a height less than the height of the upstanding side and end hull wall form members and each having their sides profiled to define reentrant sidewall portions having transverse dimensions less than the overall transverse dimensions of the nonenveloped positive flotation blocks, on the concrete mixture deposited on the bottom hull wall form member and in contact with the concrete mixture deposited on the upstanding side and/or end hull wall form members prior to curing thereof and with the plurality of positive flotation blocks being disposed in a spaced array on the bottom hull wall to yield channels intermediate adjacent flotation blocks spanning the interior of the hull;

(d) depositing a concrete mixture within the channels between adjacent nonenveloped positive flotation blocks and in overlying relation to the adjacent reentrant sidewall portions of the nonenveloped positive flotation blocks to form at least one upstanding interior concrete partial bulkhead wall spanning the hull and having a height equal to the height of the nonenveloped positive flotation blocks and for forming first wedge defining means integral with and projecting laterally from the upstanding interior concrete partial bulkhead wall(s) in overlying relation to the adjacent reentrant sidewall portions on the nonenveloped positive flotation blocks for captively retaining the same in the lower portion of the concrete hull defined by the upstanding side and end hull walls;

(e) depositing a concrete mixture in the region overlying the reentrant sidewall portions of the nonenveloped positive flotation blocks intermediate the blocks and the adjacent upstanding side and/or end walls so as to form second wedge defining means integral with and projecting laterally inward from the upstanding side and end hull walls for captively retaining the nonenveloped positive flotation blocks in the lower portion of the concrete hull defined by the upstanding side and end hull walls;

(f) curing the concrete deposited in steps (b), (d) and (e); and, (g) separating the cured buoyant concrete foundation thus formed from the bottom, side and end wall construction form members.

8. The method of claim 7, wherein the step of establishing the hollow construction form includes the step of placing a footing form member in the general form of a trough across the construction form proximate the upper edge location of an opposed pair of the upstanding side and end hull wall form members and the step of depositing concrete onto the form as set forth in step (b) includes filling the troughs to yield a thickened footing for supporting floor joist members.

9. The method of claim 7, wherein the step of establishing the hollow construction form includes positioning a fender means as a continuous vertical extension of at least one opposed pair of upstanding hull wall form members, whereby the fender means comprise a portion of the hollow construction form member and is retained as a component of the hull as fabricated.

10. The method of claim 7, wherein the step of establishing the hollow construction form includes the step of establishing an array of reinforcing members located on the form members and spaced thereform to assume a position intermediate the thickness of the hull walls to be formed.

11. The method of claim 10, further comprising the step of establishing an array of reinforcing members disposed at the locations where the channels are to be yielded, for reinforcing the partial bulkhead walls to be formed.

* * * * *